US006094761A

United States Patent [19]

Ferko, III

[11] Patent Number: 6,094,761

[45] Date of Patent: Aug. 1, 2000

[54] DISPOSABLE BACKBOARD AND BLANK FOR FORMING A BACKBOARD

[76] Inventor: Joseph G. Ferko, III, 412 Park Creek Rd., Pasadena, Md. 21122

[21] Appl. No.: 09/150,723

[22] Filed: Sep. 10, 1998

[51] Int. Cl.[7] ..... A61G 1/00

[52] U.S. Cl. ..... 5/625; 5/627; 5/417

[58] Field of Search ..... 5/625, 627, 417, 5/924

[56] References Cited

U.S. PATENT DOCUMENTS

| | | | |
|---|---|---|---|
| 2,409,195 | 10/1946 | Crawford | 602/4 |
| 2,551,976 | 5/1951 | Smith | 5/417 X |
| 2,744,713 | 5/1956 | De Villers | 108/115 |
| 2,870,461 | 1/1959 | Rosenthal | 5/93.1 |
| 3,273,518 | 9/1966 | Shina | 108/51.3 |
| 3,496,934 | 2/1970 | Anderson | 602/16 |
| 3,627,086 | 12/1971 | Caigan | 190/8 |
| 4,209,011 | 6/1980 | Peck et al. | 602/19 |
| 4,253,206 | 3/1981 | Cherry | 5/186.1 |
| 4,296,964 | 10/1981 | Haack | 5/406 |
| 4,383,526 | 5/1983 | Robins | 602/15 |
| 4,396,226 | 8/1983 | Haack | 5/402 X |
| 4,584,729 | 4/1986 | Roberts et al. | 5/924 X |
| 4,679,848 | 7/1987 | Spierings | 5/417 X |
| 4,815,155 | 3/1989 | Sommers | 5/417 X |
| 4,868,940 | 9/1989 | Masadi | 5/417 |
| 4,926,512 | 5/1990 | Coyle | 5/417 |
| 4,955,665 | 9/1990 | Richer | 5/417 X |
| 5,669,089 | 9/1997 | Dees | 5/419 |
| 5,875,576 | 3/1999 | Kram et al. | 40/299.01 |

*Primary Examiner*—Terry Lee Melius
*Assistant Examiner*—Robert G. Santos
*Attorney, Agent, or Firm*—Roylance, Abrams, Berdo & Goodman, L.L.P.

[57] ABSTRACT

A disposable backboard for carrying a patient is formed from a folded blank. The blank is stored flat and can be folded to form the backboard. The backboard has a planar center panel and a pair of tubular shaped strengthening support members extending along the bottom face of the center panel adjacent the longitudinal side edges. The strengthening support members have a substantially triangular-shaped cross-section and extend the length of the center panel. A support panel is connected to each of the strengthening members and are positioned along the bottom face of the center panel. The support panels are generally attached to the center panel to further strengthen the backboard.

26 Claims, 3 Drawing Sheets

DISPOSABLE BACKBOARD AND BLANK FOR FORMING A BACKBOARD

FIELD OF THE INVENTION

The present invention is directed to a disposable backboard for transporting a patient. More particularly, the invention is directed to a disposable backboard assembled from a folded blank and to the blank for forming the backboard.

BACKGROUND OF THE INVENTION

Backboards are an essential piece of equipment for medical and emergency personnel for safely moving a patient in a manner to minimize the risk of spinal injury. Backboards and stretchers are also essential in transporting a patient in a manner that is convenient for the medical personnel and the most comfortable to the patient.

The backboards in common use today are rigid boards having handles or openings for gripping the board. The board must be sufficiently rigid to support the weight of the patient without bunching or folding. However, the board must also be sufficiently lightweight to avoid unnecessary weight being carried by the medical personnel or paramedics. It is desirable to manufacture the backboard to be compact as reasonably possible to minimize storage space.

Conventional backboards are often made from flat sheet material such as plywood, plastic or metal. The flat backboards usually have a number of openings around the edge for lifting and receiving straps to secure the patient to the board. Other backboards are made from molded plastic materials. Another form of backboard is made of metal and has number of pivotable supporting surfaces which can be placed around the patient while in the open position. The pivotable supporting surfaces are closed to slide beneath the patient so that the patient can be positioned on the backboard without lifting the patient from the ground.

The backboards and stretchers in common used today are expensive and intended for reuse. However, a patient is typically transported to a hospital on the backboard by emergency personnel so that the backboard remains with the patient until the patient is treated and removed from the board. The board must then be returned to the emergency personnel. The expense and bulk of the existing backboards limit the number of backboards which can be stored and carried by the emergency personnel.

Accordingly, there is a continuing need in the industry for an inexpensive backboard.

SUMMARY OF THE INVENTION

The present invention is directed to a backboard and to a blank for forming a backboard. More particularly, the invention is directed to a disposable backboard.

Accordingly, a primary object of the invention is to provide a backboard that is produced from inexpensive materials and can be discarded after a single use.

Another object of the invention is to provide a blank which can be easily folded and shaped to form a rigid backboard that is sufficiently strong to support the weight of a patient.

A further object of the invention is to provide a backboard which can be stored in a flat condition and folded at the time of use to a rigid backboard structure.

Still another object of the invention is to provide a rigid backboard formed from a corrugated cardboard.

Another object of the invention is to provide a disposable backboard having runners formed from folded cardboard for supporting a patient off the ground and increasing the strength of the backboard.

A further object of the invention is to provide a blank for forming a backboard where the blank can be cut from a single die cutting step.

The objects and advantages of the invention are basically attained by providing A blank for forming a rigid backboard comprising: a center panel having first and second longitudinal side edges extending from a first longitudinally facing edge to a second longitudinally facing edge; a first intermediate support panel having a first longitudinal side edge coupled to the first longitudinal side edge of the center panel by a first fold line, and having a second longitudinal side edge opposite the first longitudinal side edge; a second intermediate support panel having a first longitudinal side edge coupled to the second longitudinal side edge of the center panel by a second fold line and having a second longitudinal side edge opposite the first side edge; a first end panel having first and second longitudinal side edges, the first longitudinal side edge being coupled to the second longitudinal side edge of the first intermediate support panel by a third fold line; and a second end panel having first and second longitudinal side edges, the first longitudinal side edge being coupled to the second longitudinal side edge of the second intermediate support panel by a fourth fold line.

The objects of the invention are further attained by providing a backboard formed from a folded blank comprising: a planar center support panel having a substantially rectangular shape with top and bottom sides, a longitudinal dimension and first and second substantially parallel side edges; a first strengthening member coupled to the first side edge of the center support panel and positioned adjacent the bottom side, the first strengthening member having a longitudinal dimension extending substantially parallel to the first side edge; a second strengthening member coupled to the second side edge of the center support panel and positioned adjacent the bottom side, the second strengthening member having a longitudinal dimension extending substantially parallel to the second side edge; a first bottom support panel having a substantially rectangular shape with substantially parallel first and second longitudinally extending side edges, the first side edge of the first bottom support panel being coupled to the first strengthening member, and the first bottom support panel being adjacent the bottom side and substantially parallel to the center support panel; and a second bottom support panel having a substantially rectangular shape with substantially parallel first and second longitudinally extending side edges, the first side edge of the second bottom support panel being coupled to the second strengthening member, the second bottom support panel being adjacent the bottom side and substantially parallel to the center support panel.

A still further object of the invention is attained by providing a backboard formed from a folded blank comprising: a planar center support panel having a substantially rectangular shape with a top and a bottom face, a longitudinal dimension and first and second substantially parallel side edges; a first strengthening member having first and second strengthening panels, each having first and second side edges, the first side edge of the first strengthening panel being coupled to the first side edge of the center panel, the second edge of the first strengthening panel being coupled to the first side edge of the second strengthening panel, and the second edge of the second strengthening panel being contiguous to the bottom face of the center panel; and a second strengthening member having first and second strengthening panels, each having first and second side edges, the first side edge of the first strengthening panel being coupled to the first side edge of the center panel, the second edge of the first strengthening panel being coupled to the first side edge of the second strengthening panel, and the second edge of the second strengthening panel being contiguous to the bottom face of the center panel.

These and other objects, advantages and salient features of the invention will become apparent from the following detailed description in conjunction with the drawings which disclose various embodiments of the invention.

BRIEF DESCRIPTION OF THE DRAWINGS

Referring to the drawings which form a part of this original disclosure in which.

DETAILED DESCRIPTION OF THE INVENTION

The present invention is directed to a backboard and to a blank which can be folded to form the backboard. The blank and the resulting backboard are preferably formed from a lightweight inexpensive and X-ray translucent material such that the backboard can be discarded after limited use. In preferred embodiments of the invention, the blank is cut from corrugated cardboard having a waterproof coating. The waterproof coating provides sufficient protection from water to retain the structural strength of the cardboard and allow the backboard to be reused, if desired. Preferably, the waterproof coating is a plastic or resin coating that is durable and non-tacky so that the blanks can be stacked without the blanks sticking together.

Figure 1:
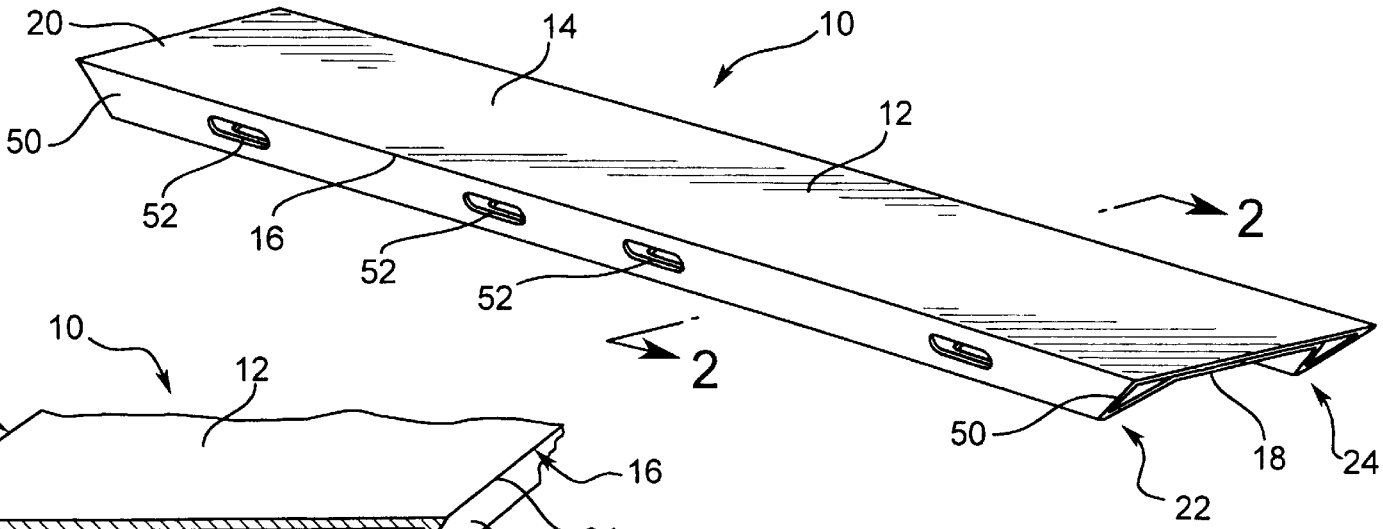
FIG. 1 is a perspective view of the backboard in a preferred embodiment of the invention.
Figure 2:
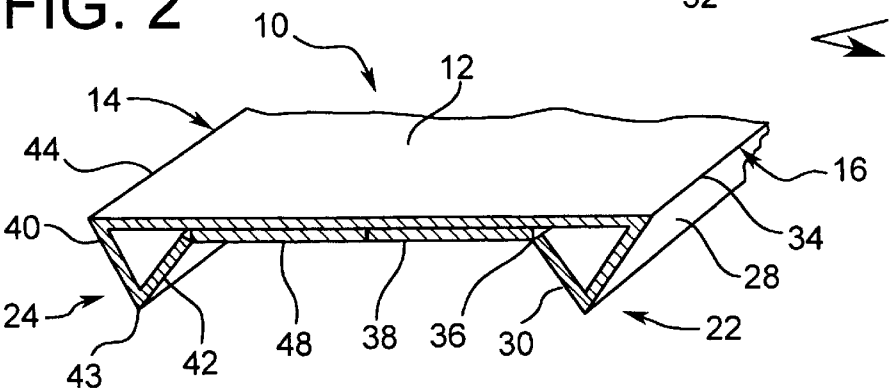
FIG. 2 is partial cross-sectional view of the backboard taken along line 2—2 of FIG. 1.
Figure 3:
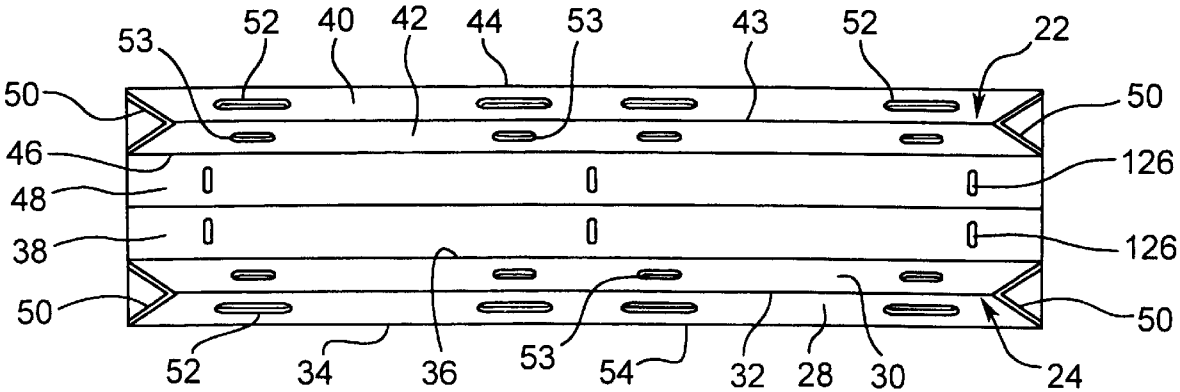
FIG. 3 is a bottom view of the backboard of FIG. 1.

Referring to FIGS. 1–3, the backboard 10 includes a center support panel 12 defining a top face having longitudinal side edges 14 and 16 and longitudinally facing ends 18 and 20. In the embodiment illustrated, the center panel 12 has a substantially rectangular shape. In preferred embodiments, center panel 12 is dimensioned to support an average-size patient completely. In one embodiment, the center panel is about 74 inches long and about 16–18 inches wide.

A pair of strengthening support members 22 and 24 are attached to the bottom face 26 of the center support panel 12. The strengthening members 22 and 24 extend along the side edges 14 and 16 of the center support panel 12 and define a pair of rails or runners extending the length of the center panel 12. Strengthening member 22 is formed from a pair of strengthening support panels 28 and 30 which are joined together along a common longitudinal bottom edge 32. The longitudinal bottom edge 32 has a length which is less than the length of the center panel 12. As shown in FIG. 2, support panel 28 includes a longitudinal side edge 34 coupled to the longitudinal side edge 16 of the center support panel 12. Support panel 30 includes a longitudinal side edge 36 which is coupled to a bottom support panel 38. Strengthening member 24 has a similar structure and includes a pair of support panels 40 and 42 coupled together along a common longitudinal bottom edge 43. Support panel 40 is coupled to the longitudinal side edge 14 of the center support panel 12 along a side edge 44. Support panel 42 includes a longitudinal edge 46 which is coupled to a second bottom support panel 48. In embodiments of the invention, the bottom support panels 38 and 48 are about 4–4½ inches wide and have a length substantially the same as the length of the center panel 12.

The support panels 28 and 30 of strengthening member 22 and support panels 40 and 42 of strengthening member 24 are positioned at an angle with respect to each other to form triangular-shaped strengthening members having a generally tubular shape extending substantially the full length of the backboard 10. The strengthening members 22 and 24 provide ground engaging support members and provide longitudinal strength to the backboard. The bottom edges 32 and 43 face downwardly from the center panel for contact with the ground. Preferably, strengthening members 22 and 24 are dimensioned to elevate the center support panel 12 from the ground during use. In embodiments of the invention, each of the support panels are about 3½–4 inches wide. Although the support members 22 and 24 are preferably formed from two panels to form a triangle, the support members can have other suitable shapes which are capable of providing sufficient strength.

Bottom support panels 38 and 48 are attached to the bottom face of the center support panel 12 to retain the backboard in the assembled position. In preferred embodiments, the bottom support panels 38 and 48 are contiguous to each other and are attached to the center support panel 12 by suitable adhesives such as a pressure-sensitive adhesive or contact adhesive. The width of bottom support panels 38 and 48 determine the spacing between the support panels 30 and 42, and therefore, determine the angle between the support panels of the support members 22 and 24. Slots 126 are provided for removing a release liner from a pressure-sensitive adhesive as discussed hereinafter in greater detail. In alternative embodiments, the bottom support panels 38 and 48 can be attached to the center support panel 12 by a suitable mechanical fastener such as staples or rivets. Bottom support panels 38 and 48 can be positioned so that the edges are spaced from each other.

Referring to FIGS. 1 and 3, the support panels which form the strengthening members 22 and 24 have longitudinal facing edges 50 which are formed at an angle with respect to the longitudinal edges of the respective panel. As shown, the longitudinal facing edges 50 are inclined toward the respective longitudinally facing end 18 and 20 of the center panel 12 and form an obtuse angle with respect to the bottom edges 32 and 43. The support panels 28 and 40 of the strengthening members 24 and 22, respectively, also include a plurality of hand-hold apertures 52 dimensioned for gripping and lifting the backboard. Support panels 30 and 42 include strap-receiving apertures 53 opposite apertures 52.

In use, a patient can be placed on the backboard 10 so that the patient is supported and the center panel 12 is elevated from the ground by the strengthening members 22 and 21. A suitable restraining strap can be passed through the apertures 52 and 53 and around the patient to secure the patient to the backboard. Similarly, a strap or belt can be passed through the apertures 52 and 53 to secure the backboard 10 to a vehicle. Preferably, apertures 52 and 53 are dimensioned and positioned to avoid weakening the backboard. The inclined edges 50 of the strengthening members 22 and 24 allow the backboard 10 to be slid underneath a patient when necessary to minimize the amount of movement to a patient required to position the patient on the backboard. Apertures 52 are preferably dimensioned to allow the hand to be inserted and grip the support members while lifting.

Figure 4:
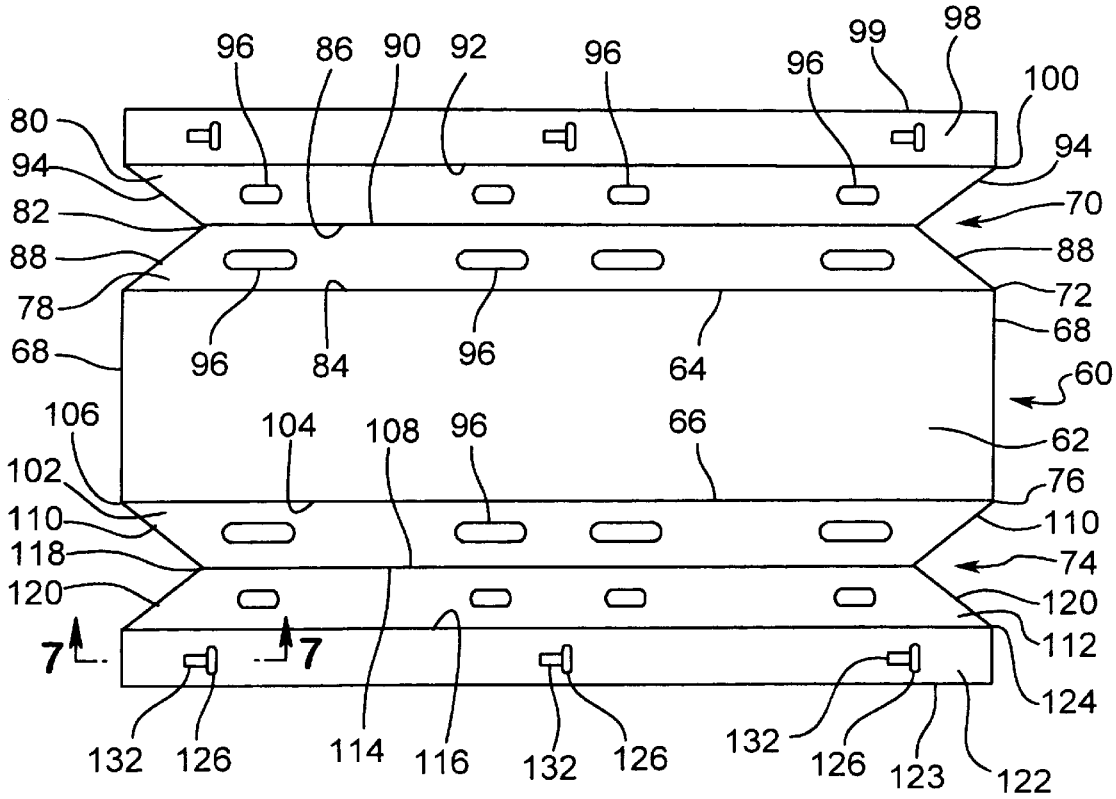
FIG. 4 is a top plan view of the blank of the invention for forming the backboard of FIG. 1.
Figure 5:
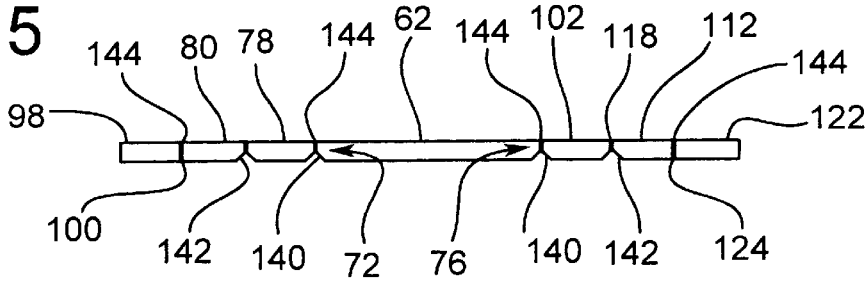
FIG. 5 is an end view of the blank of FIG. 4.

The backboard 10 of FIGS. 1–3 is preferably formed from a preformed blank as shown in FIGS. 4–7. The blank 60 is preferably cut from corrugated cardboard or other inexpensive rigid sheet material which can be folded. As shown in FIGS. 4 and 5, blank 60 is substantially flat and includes a plurality of parallel fold lines extending in a longitudinal direction with respect to the longitudinal dimension of the blank 60. Blank 60 includes a center support panel 62 having longitudinal side edges 64 and 66 and longitudinally facing edges 68. In the embodiment illustrated, the center panel 62 has a substantially rectangular shape. In further embodiments, the center panel 62 can be substantially square.

A first intermediate support panel 70 is coupled to the longitudinal side edge 64 of center panel 62 along a fold line 72. A second intermediate support panel 74 is coupled to the longitudinal side edge 64 of center panel 62 by a fold line 76.

In the embodiment illustrated, the intermediate support panel 70 includes a first leg panel 78 and a second leg panel 80 coupled together along a fold line 82 which extends parallel to fold line 72. Leg panel 78 has a first longitudinal side edge 84 coupled to the edge 64 along fold line 72 and a second longitudinal side edge 86 along the fold line 82. As shown in FIG. 4, edge 86 is shorter in length than the length of edge 84. Leg panel 78 has longitudinally facing ends 88 extending between edges 84 and 86. The second leg panel 80 has a longitudinal side edge 90 coupled to the longitudinal edge 86 along fold line 82. Leg panel 80 also includes a longitudinal edge 92 extending substantially parallel to the edge 90 and has longitudinally facing ends 94 extending between the edges 90 and 92. As shown in FIG. 4, a plurality of apertures 96 are provided in each of the leg panels 78 and 80. An end panel 98 having a substantially rectangular shape is coupled to the second leg panel 80 along the longitudinal edge 92 by a fold line 100. In preferred embodiments, edge 92 is substantially the same length as edge 84 of leg panel 78.

Intermediate panel 74 is substantially a mirror image of intermediate panel 70. Intermediate panel 74 includes a first leg panel 102 having a longitudinal edge 104 coupled to the side edge 66 of the center panel 62 by a fold line 106. Leg panel 102 includes a second longitudinal side edge 108 and longitudinally facing edges 110 extending between edges 104 and 108. A second leg panel 112 includes first and second longitudinal side edges 114 and 116. The longitudinal edge 114 of panel 112 is coupled to the longitudinal edge 108 of leg panel 102 by a fold line 118. Leg panel 112 further includes longitudinally facing edges 120 extending between the side edges 114 and 116. An end panel 122 is coupled to the side edge 116 of leg panel 112 along a fold line 124. In embodiments of the invention, end panels 98 and 122 are substantially the same length as the length of center panel 62.

Figure 6:
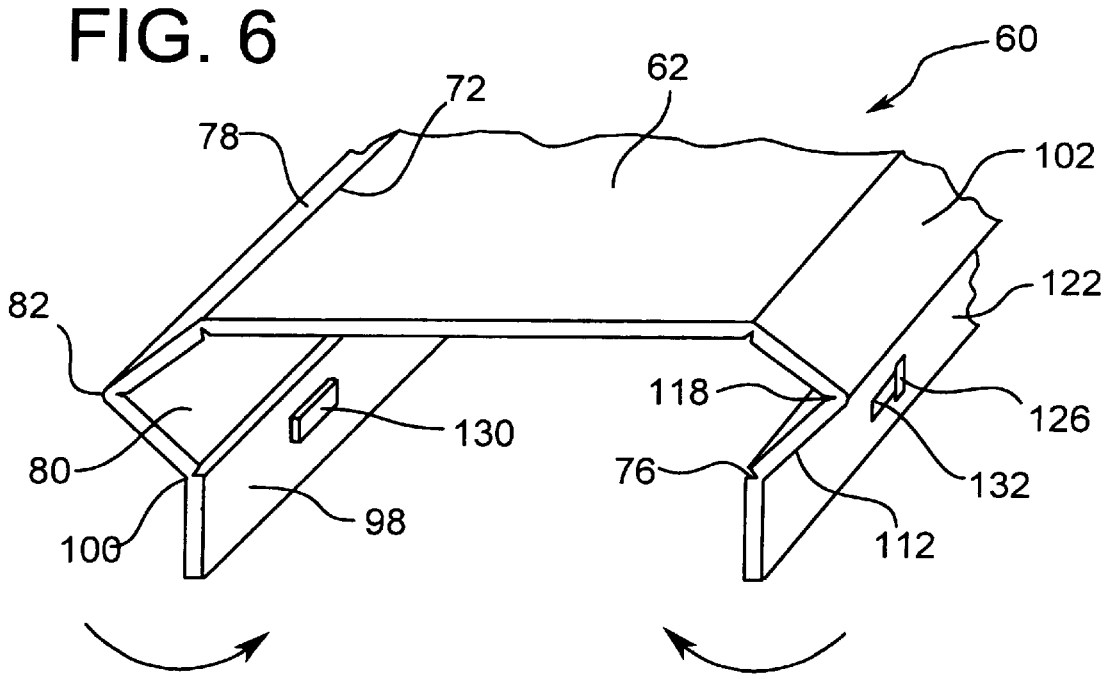
FIG. 6 is a partial perspective view of the blank of FIG. 1 in the partially folded position.

In the embodiment illustrated, the blank 60 is formed from a rigid sheet material, such as corrugated cardboard. In one embodiment of the invention, the sheet material is one-half inch thick corrugated cardboard. Each of the fold lines of the blank 60 can be formed using standard equipment. Depending on the thickness of the sheet material, the fold lines are preferably formed by scoring, crimping or routing the surface of the sheet material to allow the sheet material to bend sufficiently to form the backboard without severing or breaking the panels along the fold lines. FIGS. 2 and 6 illustrate the effect of forming the fold lines by scoring and routing, such that a portion of the material is cut while leaving a sufficient thickness to hinge the panels together.

Referring to FIG. 5 illustrating an end view of the blank 60, fold lines 72 and 106 are formed by routing V-shaped grooves 140 on the bottom face. Similarly, fold lines 82 and 118 are formed by a V-shaped groove 142 on the bottom face. Fold lines 72 and 124 are formed by slits 144 on the top face. The V-shaped grooves 140 and 142 enable the panels to be folded so that faces of the grooves contact each other and the uncut portion forms the outer corner of the fold as shown in FIG. 6.

As shown in FIG. 4, the longitudinally facing edges 88, 94, 110 and 112 of the leg panels are formed at an angle with respect to the longitudinal fold lines. Each of the longitudinally facing ends converge toward the respective fold line between the adjoining leg panels. In this manner, the longitudinally facing ends form a substantially V-shaped notch in the ends of the blank 60.

Figure 5A:
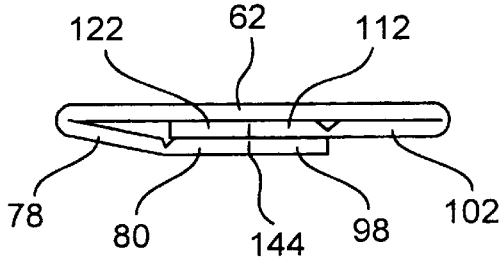
FIG. 5A is an end view of the folded blank of FIG. 4 during storage.

The blank 60 can be stored flat as shown in FIG. 4 for stacking. In further embodiments, the blank 60 can be folded along fold lines 72 and 106 so that the leg panels 102, 112, 78 and 80 are folded flat onto center panel 62 as shown in FIG. 5A. In this manner, width of the panel is significantly reduced during storage.

The backboard is formed from the blank 60 by folding the blank along fold lines 82 and 118 to form a V-shaped support member as shown in FIG. 6 corresponding to the support members 22 and 24 shown in FIGS. 1–3. FIG. 6 shows the blank 60 in the partially folded position. The panel 60 is then folded along fold lines 72 and 76 to pivot the intermediate panels 70 and 74 to the bottom side of the center panel 62. End panels 98 and 122 are folded along fold lines 100 and 124, respectively, into contact with the bottom face of the center panel 62 to produce the structure as shown in FIG. 2. Preferably, end panels 98 and 122 are dimensioned to cover the bottom face of center panel 62. The longitudinal edges 99 and 123 of panels 98 and 122 preferably abut one another when folded flat against the center panel 62.

Figure 7:
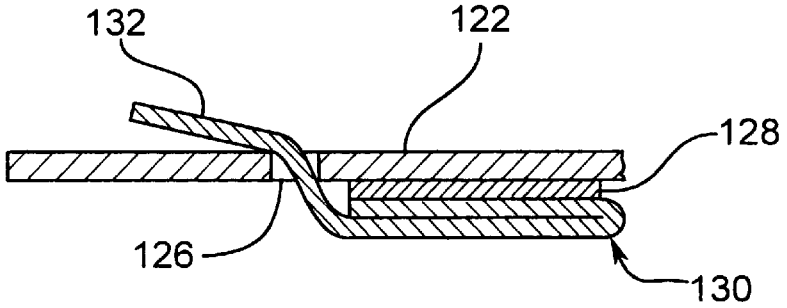
FIG. 7 is a cross-sectional side view taken along line 7—7 of FIG. 4 showing the adhesive tab for retaining the blank in the folded position.
Figure 8:
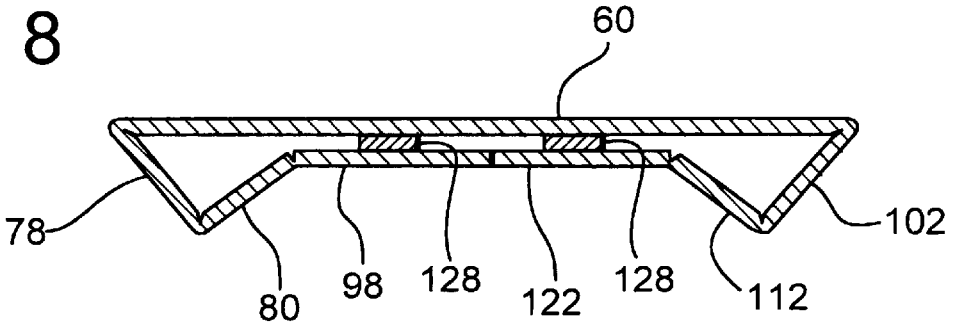
FIG. 8 is a cross-sectional side view of the folded blank of FIG. 4 showing the adhesive strips attaching the end panels to the center panel.

End panels 98 and 122 are preferably fixed to the center panel 62 by a suitable adhesive. In preferred embodiments of the invention as illustrated in FIGS. 4 and 7, end panels 98 and 122 include several slots 126 and a double-sided, pressure-sensitive adhesive tape 128 adjacent each slot 126. A release sheet 130 covers the pressure-sensitive adhesive tape 128 and includes a tab 32 which is folded back onto itself and extends through the slot 126 as shown in FIG. 7. When the end panels 98 and 122 are folded inwardly to contact the bottom surface of the center panel 62, the tabs 132 of the release sheet 130 are pulled through the slots 126 to expose the pressure-sensitive adhesive tape 128. The end panels 98 and 122 are pressed against the center panel 62 so that the pressure-sensitive adhesive tape 128 fixes the end panels 98 and 122 to the center panel 62.

While various embodiments of the invention have been chosen to illustrate the invention, it will be apparent from one skilled in the art that various other modifications can be made without departing from the spirit and scope of the invention as defined in the appended claims.

What is claimed is:

1. A blank of a rigid and foldable sheet material for forming a rigid backboard, said blank comprising:

a center panel having first and second longitudinal side edges extending from a first longitudinally facing edge to a second longitudinally facing edge;

a first intermediate support panel having a first longitudinal side edge coupled to said first longitudinal side edge of said center panel by a first fold line, and having a second longitudinal side edge opposite said first longitudinal side edge;

a second intermediate support panel having a first longitudinal side edge coupled to said second longitudinal side edge of said center panel by a second fold line and having a second longitudinal side edge opposite said first side edge;

a first end panel having first and second longitudinal side edges, said first longitudinal side edge being coupled to said second longitudinal side edge of said first intermediate support panel by a third fold line;

a second end panel having first and second longitudinal side edges, said first longitudinal side edge being coupled to said second longitudinal side edge of said second intermediate support panel by a fourth fold line;

said first intermediate support panel having a longitudinal fifth fold line extending substantially parallel to said first and second longitudinal side edges to define first and second leg panels of said first intermediate support panel coupled together by said fifth fold line; and said second intermediate support panel having a longitudinal sixth fold line extending substantially parallel to said first and second longitudinal side edges of said second intermediate support panel to define first and second leg panels of said second intermediate support panel coupled together by said sixth fold line.

2. The blank of claim 1, wherein said center panel is substantially rectangular.

3. The blank of claim 1, wherein said first and second leg panels of said first intermediate panel have a substantially trapezoidal shape with first and second longitudinally facing ends, and wherein said first and second longitudinally facing ends of said first and second leg panels converge inwardly to said fifth fold line, and wherein said first and second leg panels of said second intermediate support panel have a substantially trapezoidal shape with first and second longitudinally facing ends, and wherein said first and second longitudinally facing ends of said first and second leg panels converge inwardly toward said sixth fold line.

4. The blank of claim 1, wherein each of said leg panels include at least one aperture.

5. The blank of claim 1, wherein said blank is formed from corrugated cardboard.

6. A backboard formed from a folded blank comprising:

a planar center support panel having a substantially rectangular shape with top and bottom sides, a longitudinal dimension and first and second substantially parallel side edges;

a first strengthening member coupled to said first side edge of said center support panel by a fold line and positioned adjacent said bottom side, said first strengthening member having a longitudinal dimension extending substantially parallel to said first side edge;

a second strengthening member coupled to said second side edge of said center support panel by a fold line and positioned adjacent said bottom side, said second strengthening member having a longitudinal dimension extending substantially parallel to said second side edge;

a first bottom support panel having a substantially rectangular shape with substantially parallel first and second longitudinally extending side edges, said first side edge of said first bottom support panel being coupled to said first strengthening member by a fold line, and said first bottom support panel contacting said bottom side and substantially parallel to said center support panel; and a second bottom support panel having a substantially rectangular shape with substantially parallel first and second longitudinally extending side edges, said first side edge of said second bottom support panel contacting to said second strengthening member by a fold line, said second bottom support panel being adjacent said bottom side and substantially parallel to said center support panel.

7. The backboard of claim 6, wherein said first strengthening member comprises first and second strengthening panels coupled together by a fold line, each of said panels having first and second side edges, said first side edge of said first strengthening panel being coupled to said first side edge of said center panel, said second edge of said first strengthening panel being coupled to said first side edge of said second strengthening panel, and said second edge of said second strengthening panel being contiguous to said bottom face of said center panel; and said second strengthening member having first and second strengthening panels coupled together by a fold line, each having first and second side edges, said first side edge of said first strengthening panel being coupled to said second side edge of said center panel, said second edge of said first strengthening panel being coupled to said first side edge of said second strengthening panel, and said second edge of said second strengthening panel being contiguous to said bottom face of said center panel.

8. The backboard of claim 6, wherein said first and second bottom support panels are adhesively attached to said bottom face of said center panel.

9. The backboard of claim 6, wherein each of said second edges of each bottom support panel are contiguous.

10. The backboard of claim 7, wherein said strengthening panels have a substantially trapezoidal shape.

11. The backboard of claim 10, wherein said first and second strengthening panels have first and second opposite longitudinally facing edges, said first edge of said first strengthening panel and said first edge of said second strengthening panel converging toward said second longitudinal edge of said first strengthening panel.

12. The backboard of claim 9, wherein said first and second strengthening panels of said first and second strengthening members include a plurality of apertures.

13. A backboard formed from a folded blank comprising:

a planar center support panel having a substantially rectangular shape with a top and a bottom face, a longitudinal dimension and first and second substantially parallel side edges;

a first strengthening member having first and second strengthening panels, each having first and second side edges, said first side edge of said first strengthening panel being coupled to said first side edge of said center panel by a fold line, said second edge of said first strengthening panel being coupled to said first side edge of said second strengthening panel by a fold line, and said second edge of said second strengthening panel being contiguous to said bottom face of said center panel; and a second strengthening member having first and second strengthening panels, each having first and second side edges, said first side edge of said first strengthening panel being coupled to said first side edge of said center panel by a fold line, said second edge of said first strengthening panel being coupled to said first side edge of said second strengthening panel by a fold line, and said second edge of said second strengthening panel being contiguous to said bottom face of said center panel.

14. The backboard of claim 13, further comprising a first bottom support panel having a first and a second longitudinal side edge, said first longitudinal side edge being coupled to said second edge of said second strengthening panel of said first strengthening member by a fold line.

15. The backboard of claim 14, wherein said first bottom support panel is substantially parallel to said center panel.

16. The backboard of claim 15, wherein said first bottom support panel is attached to said center panel.

17. The backboard of claim 14, wherein said first bottom support member has a length substantially equal to a length of said center panel.

18. The backboard of claim 13, wherein said first and second strengthening members have a substantially triangular-shaped cross-section.

19. The backboard of claim 13, wherein said first side edge of said first strengthening panel has a length greater than a length of said second side edge of said first strengthening panel.

20. The backboard of claim 19, wherein said first edge of said first strengthening panel and said second side edge of said second strengthening panel of said first strengthening member have a length substantially equal to a length of said center panel.

21. The backboard of claim 13, further comprising a second bottom support panel having a first longitudinal side edge coupled to said second edge of said second strengthening panel of said second support member.

22. The backboard of claim 13, wherein said first and second strengthening panels of said first and second strengthening members have a plurality of apertures therein.

23. The backboard of claim 21, wherein said first and second bottom support panels have a second edge, said second edge of said first bottom support panel being contiguous with said second edge of said second bottom support panel.

24. The backboard of claim 23, wherein said first and second bottom support panels are substantially the same width and are dimensioned to form a snap-fit adjacent said center support panel.

25. The backboard of claim 21, wherein said first and second bottom support panels are adhesively attached to said center panel.

26. The backboard of claim 13, wherein said backboard is a unitary member and said center panel and first and second strengthening members are formed from a single piece of sheet material.

* * * * *